US010611604B2

(12) United States Patent
Lindegger

(10) Patent No.: US 10,611,604 B2
(45) Date of Patent: Apr. 7, 2020

(54) ELEVATOR SYSTEM

(71) Applicant: Inventio AG, Hergiswil (CH)

(72) Inventor: Urs Lindegger, Ebikon (CH)

(73) Assignee: INVENTIO AG, Hergiswil, NW (CH)

( * ) Notice: Subject to any disclaimer, the term of this patent is extended or adjusted under 35 U.S.C. 154(b) by 373 days.

(21) Appl. No.: 15/531,492

(22) PCT Filed: Nov. 26, 2015

(86) PCT No.: PCT/EP2015/077777
§ 371 (c)(1),
(2) Date: May 30, 2017

(87) PCT Pub. No.: WO2016/083507
PCT Pub. Date: Jun. 2, 2016

(65) Prior Publication Data

US 2017/0267489 A1 Sep. 21, 2017

(30) Foreign Application Priority Data

Nov. 28, 2014 (EP) ..... 14195381

(51) Int. Cl.
*B66B 7/12* (2006.01)
*B66B 5/00* (2006.01)
*B66B 7/06* (2006.01)

(52) U.S. Cl.
CPC ..... *B66B 7/1223* (2013.01); *B66B 5/0018* (2013.01); *B66B 7/062* (2013.01)

(58) Field of Classification Search
CPC ..... B66B 7/1223; B66B 5/0018; B66B 7/062
USPC ..... 187/393
See application file for complete search history.

(56) References Cited

U.S. PATENT DOCUMENTS 7,123,030 B2 * 10/2006 Robar ..... B66B 7/1223 324/693
7,409,870 B2 * 8/2008 Stucky ..... B66B 7/062 73/810
8,011,479 B2 * 9/2011 Stucky ..... B66B 7/1223 187/391
8,807,286 B2 * 8/2014 Puranen ..... B66B 5/0018 187/391
8,813,918 B2 * 8/2014 Kocher ..... B66B 7/1223 187/391
9,327,941 B2 * 5/2016 Dold ..... B66B 7/1223
9,385,447 B2 * 7/2016 Dold ..... B66B 7/1223
9,423,369 B2 * 8/2016 Fargo ..... B66B 7/1223
9,599,582 B2 * 3/2017 Fargo ..... G01N 27/20
(Continued)

FOREIGN PATENT DOCUMENTS

CN 100564215 C 12/2009
CN 102256888 A 11/2011
(Continued)

*Primary Examiner* — David S Warren
(74) *Attorney, Agent, or Firm* — William J. Clemens; Shumaker, Loop & Kendrick, LLP

(57) ABSTRACT

An elevator system includes a suspension apparatus that has a plurality of tension members in a common jacket. The tension members of the suspension apparatus are electrically interconnected in an electric circuit which includes a current source or a voltage source and a measuring device. The measuring device is connected between a first group of the tension members and a second group of the tension members.

13 Claims, 2 Drawing Sheets

(56) References Cited

U.S. PATENT DOCUMENTS

| | | | | |
|---|---|---|---|---|
| 9,975,734 | B2 * | 5/2018 | Dold | B66B 7/1223 |
| 9,981,830 | B2 * | 5/2018 | Dold | B66B 7/062 |
| 10,023,433 | B2 * | 7/2018 | Dold | B66B 7/062 |
| 10,202,258 | B2 * | 2/2019 | Dold | B66B 5/02 |
| 10,336,580 | B2 * | 7/2019 | Cereghetti | B66B 7/1223 |
| 2002/0194935 | A1 * | 12/2002 | Clarke | B66B 7/1223 73/862.391 |
| 2003/0121729 | A1 * | 7/2003 | Heinz | B66B 7/062 187/254 |
| 2011/0253487 | A1 * | 10/2011 | Kocher | B66B 7/1223 187/393 |
| 2013/0153340 | A1 * | 6/2013 | Dold | B66B 7/1223 187/393 |
| 2013/0157497 | A1 * | 6/2013 | Dold | B66B 7/1223 439/413 |
| 2015/0291394 | A1 * | 10/2015 | Dold | B66B 7/062 324/693 |
| 2015/0298941 | A1 * | 10/2015 | Dold | B66B 7/062 187/393 |
| 2015/0307323 | A1 * | 10/2015 | Zapf | B66B 7/062 187/411 |
| 2015/0336769 | A1 * | 11/2015 | Dold | B66B 7/1223 187/393 |
| 2016/0101964 | A1 * | 4/2016 | Dold | B66B 19/02 29/593 |
| 2017/0275135 | A1 * | 9/2017 | Dold | B66B 5/02 |
| 2017/0334677 | A1 * | 11/2017 | Dold | B66B 7/1223 |
| 2018/0105391 | A1 * | 4/2018 | Dold | B66B 7/062 |
| 2019/0047822 | A1 * | 2/2019 | Dold | G01M 5/0033 |

FOREIGN PATENT DOCUMENTS

| | | | |
|---|---|---|---|
| CN | 104024136 | B | 9/2014 |
| DE | 3934654 | A1 | 5/1991 |
| EP | 2336072 | A1 | 6/2011 |
| WO | 2005094248 | A2 | 10/2005 |

* cited by examiner

ELEVATOR SYSTEM

FIELD

The present invention relates to a device and a method for monitoring at least one suspension means in an elevator system.

BACKGROUND

For elevator systems, steel cables have traditionally been used as suspension means for carrying and/or driving an elevator car. According to a further development of such steel cables, belt-like suspension means are used that have tension members and a sheathing arranged around the tension members. However, such belt-like suspension means cannot be monitored in the traditional manner because the tension members, which determine the breaking load of the suspension means, are not visible through the sheathing.

To monitor such tension members in belt-like suspension means, a test current can be applied to the tension members. In the circuit configured in this way, a current flow or a current strength, a voltage, an electrical resistance or an electrical conductivity is measured. It is possible to draw a conclusion about the intactness of the tension members of the suspension means based on a quantity measured in this way.

Publication DE 3934654 A1 discloses such a device or such a method for the determination of a state of the tension members of a belt-like suspension means. Using a circuit in which all tension members of the suspension means are connected in series, it can be easily determined whether at least one of the tension members is broken or not.

Although one such monitoring method described in the prior art is reliable in the monitoring of breakages of tension members, no other damage to the suspension means can be determined with it.

SUMMARY

It is therefore an object of the present invention to provide a device and a method for monitoring a suspension means in an elevator system that permit a reliable conclusion about various damages to the suspension means. Moreover, the device or the method is to be robust with respect to disruptive influences.

To achieve this object, an elevator system having a suspension means is first proposed, wherein the suspension means comprise a plurality of electrically conductive tension members arranged parallel to and next to each other in a common plane, are electrically insulated from each other and are surrounded by a common jacket. In this arrangement all tension members of the suspension means are electrically interconnected. This circuit includes a current or voltage source and a measuring device. The measurement device is arranged between a first group of tension members and a second group of tension members, so that electrical current from the current or voltage source first flows through the first group of tension members then flows through the measuring device and finally flows through the second group of tension members back to the current or voltage source. The tension members of the first group of tension members and/or the tension members of the second group of tension members in this arrangement are connected in series.

This device has the advantage that various states of the suspension means can be reliably detected by such an arrangement of a circuit. First, it can be determined whether one or a plurality of tension members of the suspension means are broken. The measuring device in this arrangement can determine in a simple way whether current is essentially flowing through the circuit or essentially no current is flowing through the circuit.

In an advantageous embodiment, each tension member of the first group is directly adjacent only to tension members of the second group and each tension member of the second group is directly adjacent only to tension members of the first group.

By interconnection of the tension members in a first group and in a second group of tension members, wherein the measuring device is arranged between the first group and the second group, and wherein the tension members are each assigned alternately to the first group and to the second group, it can further be determined if there is an electrical contact between two adjacent tension members. If such a contact between adjacent tension members occurs, the circuit is shortened to a certain degree, so that a marked drop in the amperage or the voltage can be detected at the measuring device in a simple way.

Using the proposed device, it is also possible to detect an electrical contact of directly adjacent tension members if two tension members that are not directly adjacent from different groups of tension members are electrically interconnected via a further electrically conductive element. This can occur, for example, if the jacket of the suspension means is damaged and the two tension members that are not directly adjacent from different groups of tension members are guided over an electrically conductive pulley, such as a deflection pulley at the counterweight, at the damaged location. Also in this case, the circuit is shortened to a certain degree, so that a marked drop in the amperage or the voltage can be detected at the measuring device in a simple way.

Because precise values do not need to be detected in the proposed device, this device is very robust with respect to disruptive effects, such as temperature fluctuations, electromagnetic radiation, movements of the suspension means and the like. A change of the state in the suspension means results in a marked change in the amperage or the voltage or the electrical resistance in the measuring device. Thus, it only needs to be determined whether a detected value is above or below a predefined limit value.

In an advantageous exemplary embodiment, the first group of tension members and the second group of tension members have an equal number of tension members.

In an advantageous exemplary embodiment, the measuring device is configured as an ammeter or as a voltmeter. Depending on whether a current or a voltage source is used, it is possible to select an ammeter or a voltmeter as the measuring device.

In an advantageous exemplary embodiment, the current or voltage source is designed for the generation of an alternating current or a direct current.

In an advantageous exemplary embodiment, the circuit further includes a line isolation monitor. This has the advantage that another condition of the suspension means can thereby be monitored. In the case of an exposed tension member or a wire protruding through the jacket, a ground fault to a grounded object in the elevator system can occur. For example, an exposed tension means or a protruding wire can produce electrical contact with a traction sheave or a deflection pulley. The line isolation monitor can easily determine whether such a ground fault is present or not.

In an advantageous exemplary embodiment, two tension members are electrically interconnected at a first end of the suspension means. Moreover, at a second end of the suspension means two tension members are electrically connected to the current or voltage source, two additional tension members are electrically connected to the measuring device, and any additional tension members are electrically interconnected in pairs. This has the advantage that the current or voltage source and the measuring device are arranged at the same end of the suspension means. Thus, no other equipment is connected at the respective other end of the suspension means. This simplifies the installation of such a monitoring system in an elevator system.

To achieve the object posed at the outset, a method for the monitoring of at least one suspension means in an elevator system is further proposed, the suspension means comprising a plurality of electrically conductive tension members arranged parallel to and next to each other in a common plane that are electrically insulated from each other and are surrounded by a common jacket. The method comprises the steps: conduction of the test current through a first group of tension members; conduction of the test current through the second group of tension members; and determination of a characteristic of the test current using a measuring device, the test current being conducted through the measuring device after it is conducted through the first group of tension members and before it is conducted through the second group of tension members.

This method further provides the advantage that different states of the suspension means can easily be determined. Thus, it can be determined with great reliability whether a tension member is broken and whether there is an electrical contact between two adjacent tension members. In both cases, an amperage or a voltage on the measuring device markedly changes. Thus, it is necessary to determine exact values using the measuring device. This makes the method more robust with respect to disruptive influences, such as temperature fluctuations, electromagnetic radiation, movements of the suspension means and the like.

In an advantageous exemplary embodiment, as the test current is conducted through the first group of tension members, the tension members of this first group are spaced apart from each other by a tension member of the second group of tension members, and as the test current is conducted through the second group of tension members, the tension members of this second group are spaced apart from each other by a tension member of the first group of tension members.

In an advantageous exemplary embodiment, as the test current is conducted through the first group of tension members and through the second, the tension members of the first group of tension members and/or the tension members of the second group of tension members are connected in series.

In an advantageous exemplary embodiment, the test current is conducted through all tension members of the suspension means.

In an advantageous exemplary embodiment, for the conduction of the test current, an alternating current or a direct current or an electric signal is conducted through the tension members.

In an advantageous exemplary embodiment, for the determination of the test current characteristic, a voltage or an amperage or a signal property is determined.

In an advantageous exemplary embodiment, for the determination of the test current characteristic, a determination is made as to whether the characteristic is above or below a predefined rational value.

In an advantageous exemplary embodiment, the method includes the step: checking of the circuit comprising at least the first group of tension members and the second group of tension members for ground fault. This have the advantage that another condition of the suspension means can thereby be determined. By checking the circuit ground fault, it is possible to determine whether tension members are exposed or whether wires protrude from the jacket. In these cases, this can involve a ground fault with the grounded element of the elevator system having the tension members.

The device disclosed here or the method disclosed here for monitoring a suspension means in an elevator system may be used in various types of elevator systems. Thus, for example, elevator systems with or without a shaft, with or without a counterweight, or elevator systems having different transmission ratios may be used. Thus, each tension member in an elevator system, which includes a plurality of electrically conductive tension members that are surrounded by a common insulating jacket, are monitored using the methods disclosed here or using the device disclosed here.

DESCRIPTION OF THE DRAWINGS

The invention is explained in detail symbolically and by way of example in reference to figures. Shown are.

DETAILED DESCRIPTION

Figure 1:
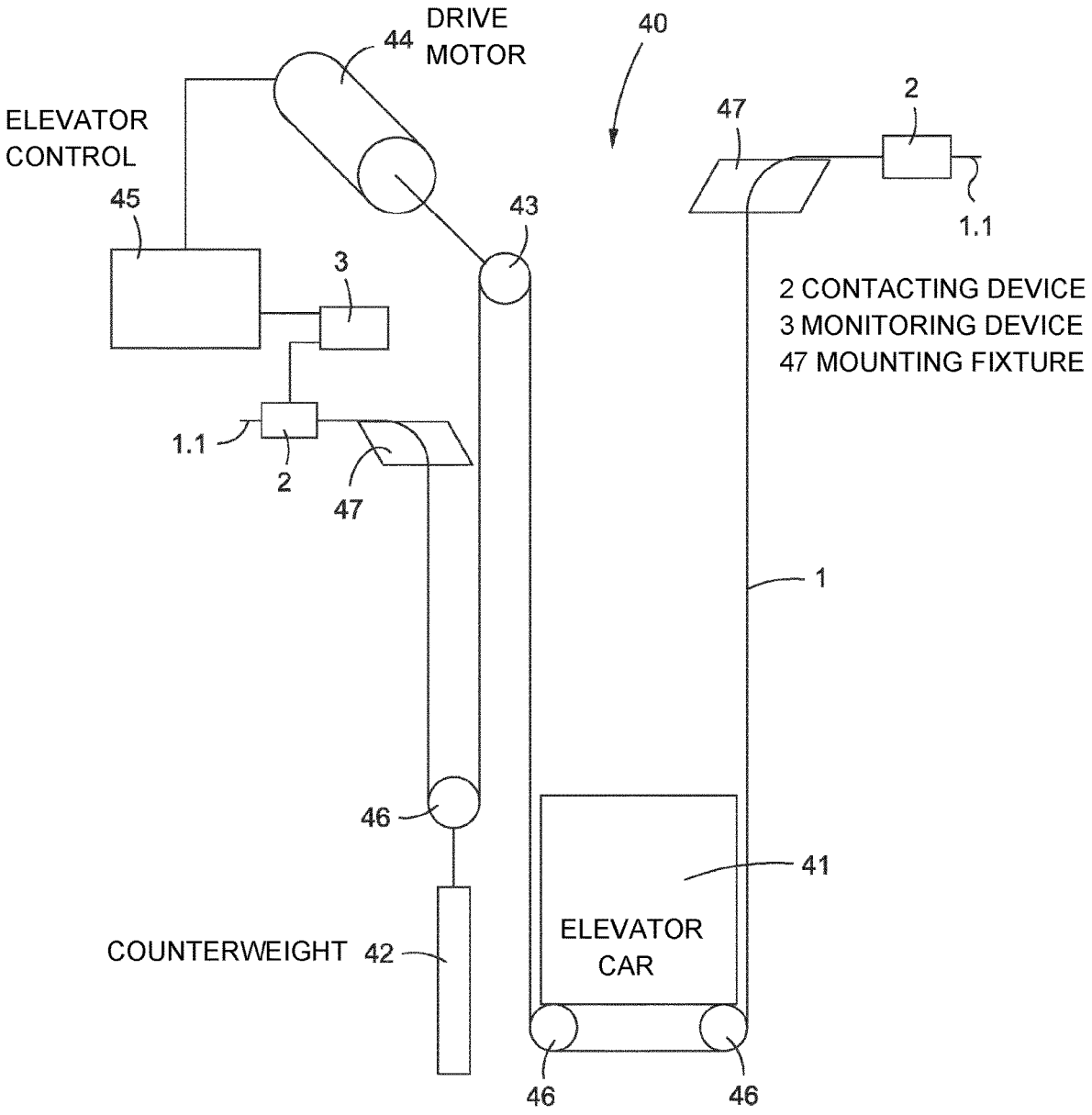
FIG. 1 is an exemplary embodiment of an elevator system.

The elevator system 40 depicted schematically and by way of example in FIG. 1 includes an elevator car 41, a counterweight 42 and a suspension means or apparatus 1, as well as a traction sheave 43 along with associated drive motor 44. Traction sheave 43 drives suspension means 1 and thereby moves elevator car 41 and, in mirror-inverted motion, counterweight 42. Drive motor 44 is controlled by an elevator control 45. Car 41 is designed to hold people or freight and transport them between floors of a building. Car 41 and counterweight 42 are guided along by guides (not depicted). In the example, car 41 and counterweight 42 are each suspended on support rollers 46. In this arrangement, suspension means 1 is secured to a first suspension means mounting fixture 47 and then first guided around support roller 46 of counterweight 42. Then, suspension means 1 is placed over traction sheave 43, guided around support roller 46 of car 41 and finally connected to a fixed point by a second suspension means mounting fixture 47. This means that suspension means 1 runs through drive 43, 44 at a higher speed than car 41 or counterweight 42 corresponding to a reeving factor. In the example the reeving factor is 2 to 1.

A loose end 1.1 of suspension means 1 is provided with contacting device 2 for the temporary or permanent electrical contacting of the tension members and, thus, for monitoring suspension means 1. In the depicted example, a contacting device 2 of this type is arranged at both ends 1.1 of suspension means 1. Suspension means ends 1.1 are no longer loaded by the tensile force in suspension means 1 because this tensile force is already conducted beforehand through the suspension means mounting fixtures 47 into the building. The contacting devices 2 are therefore arranged in an area of suspension means 1 that is not rolled over and are outside the loaded area of suspension means 1.

In the example, contacting device 2 is connected at one end of suspension means 1.1 to a monitoring device 3.

Monitoring device 3 includes a current or voltage source and a measuring device. Moreover, monitoring device 3 is connected to elevator control 45. This connection can be designed, for example, as a parallel relay or as a bus system. As a result, a signal or a measured value can be transmitted by monitoring device 3 to elevator control 45 in order to consider the condition of suspension means 1, as determined by monitoring device 3, in a controller of elevator 40.

Elevator system 40 shown in FIG. 1 is an example. Other reeving factors and arrangements, such as elevator systems without a counterweight, are possible. Contacting device 2 for contacting suspensions means 1 is then arranged corresponding to the placement of suspension means mounting fixtures 47.

Figure 2:
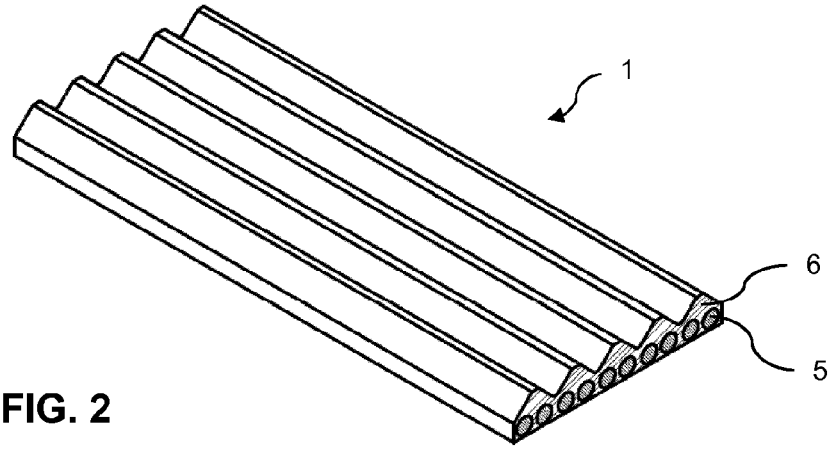
FIG. 2 is an exemplary embodiment of a suspension means.

Depicted in FIG. 2 is a section of an exemplary embodiment of a suspension means 1. Suspension means 1 includes a plurality of electrically conductive tension members 5 arranged parallel to and next to each other in a common plane and surrounded by a common electrically insulated jacket 6. For the electrical contacting of tension members 5, jacket 6 can, for example, be pierced or removed, or tension members 5 can also be electrically contacted on the end face by a contacting device 2. Furthermore, contact elements can also be attached to tension member 5, which can then be connected in a simple manner to contacting device 2. In this example, suspension means 1 is equipped with longitudinal ribs on a traction side. Such longitudinal ribs improve the traction behavior of suspension means 1 on traction sheave 43 and also facilitate a lateral guidance of suspension means 1 on traction sheave 43. However, suspension means 1 can also be designed differently, for example, without longitudinal ribs or with a different number or a different arrangement of tension members 5. It is essential for the invention for tension members 5 to be designed as electrically conductive.

Figure 3:
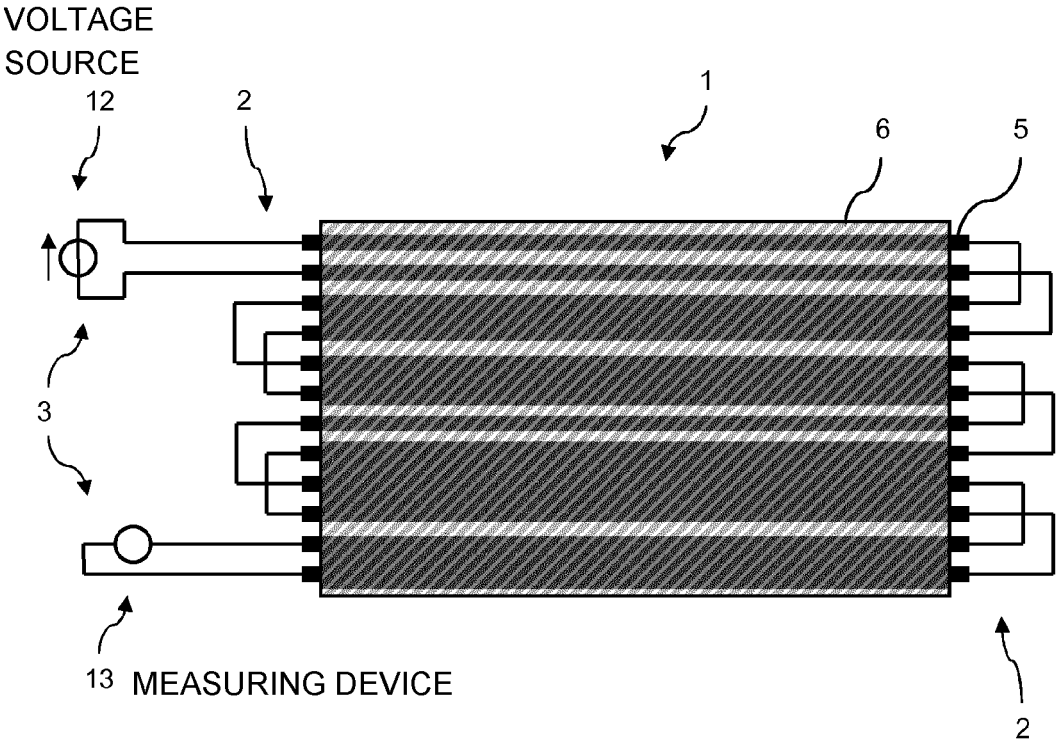
FIG. 3 is an exemplary embodiment of a suspension means having a monitoring device.

An exemplary embodiment of a suspension means 1 is depicted in FIG. 3 with contacting devices 2 and a monitoring device 3. At a first end of suspension means 1, the tension members are each contacted by contacting device 2 and each two tension members 5 are electrically connected to each other. At a second end of suspension members 1, two tension members are electrically connected to a voltage source 12, two further tension members 5 are connected to a measuring device 13, and the remaining tension members 5 are each electrically connected in pairs. Also at these two ends of the suspension 1, all tension members 5 of suspension means 1 are electrically contacted by contacting device 2.

Voltage source 12 and measurement device 13 thus form monitoring device 3. Various states of suspension means 1 can be detected in a simple manner via the depicted circuit configuration of tension members 5 in a single circuit and via the specific arrangement of measuring device 13 and voltage source 12. In particular, an electrical contact between two adjacent tension members 5 can be detected via this arrangement.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system including a suspension apparatus having a plurality of electrically conductive tension members arranged parallel to and next to each other in a common plane, the tension members being electrically insulated from each other and surrounded by a common jacket, all of the tension members being interconnected forming a circuit comprising;

a current source or a voltage source connected to the tension members; and a measuring device connected between a first group of the tension members and a second group of the tension members wherein electrical current from the current source or the voltage source flows first through the tension members of the first group, then through the measuring device and finally through the tension members of the second group back to the current source or the voltage source, and wherein the tension members of at least one of the first group and the second group are interconnected; and wherein a first two of the tension members are electrically interconnected at a first end of the suspension apparatus, a second two of the tension members are electrically connected to the current source or the voltage source at a second end of the suspension apparatus, a third two of the tension members are electrically connected to the measuring device, and any remaining of the tension members are interconnected as pairs.

2. The elevator system according to claim 1 wherein each of the tension members of the first group is directly adjacent only to the tension members of the second group, and wherein each of the tension members of the second group is directly adjacent only to the tension members of the first group.

3. The elevator system according to claim 1 wherein a number of the tension members in the first group is equal to a number of the tension members in the second group.

4. The elevator system according to claim 1 wherein the measuring device is configured as an ammeter or as a voltmeter.

5. The elevator system according to claim 1 wherein the current or the voltage source generates an alternating current or a direct current.

6. The elevator system according to claim 1 wherein the circuit further includes a line isolation monitor.

7. A method for monitoring a suspension apparatus in an elevator system, wherein the suspension apparatus includes a plurality of electrically conductive tension members arranged parallel to and next to each other in a common plane, the tension members being electrically insulated from each other and surrounded by a common jacket, the method comprising the steps of:

conducting a test current through a first group of the tension members;

conducting the test current through a second group of tension members;

determining a characteristic of the test current using a measuring device, wherein the test current is conducted through the measuring device after it is conducted through the first group of tension members and before it is conducted through the second group of tension members; and wherein a first two of the tension members are electrically interconnected at a first end of the suspension apparatus, a second two of the tension members are electrically connected to the current source or the voltage source at a second end of the suspension apparatus, a third two of the tension members are electrically connected to the measuring device, and any remaining of the tension members are interconnected as pairs.

8. The method according to claim 7 wherein, as the test current is conducted through the first group of tension members, the tension members of the first group are each spaced apart from each other by one of the tension members of a second group, and wherein, as the test current is conducted through the second group of tension members, the tension members of the second group are each spaced apart from each other by one of the tension members of the first group.

9. The method according to claim 7 wherein the test current is conducted through all of the tension members of the suspension apparatus.

10. The method according to claim 7 wherein the test current is one of an alternating current, a direct current and an electrical signal.

11. The method according to claim 7 wherein the characteristic of the test current is one of a voltage, an amperage, a resistance and a signal property.

12. The method according to claim 7 wherein, in the determination of the characteristic of the test current, it is determined whether the characteristic is above or below a predefined threshold value.

13. The method according to claim 7 including the step of:

checking the circuit including the first group of tension members and the second group of tension members for a ground fault.

* * * * *